US005083334A

United States Patent [19]

Huck et al.

[11] Patent Number: 5,083,334

[45] Date of Patent: Jan. 28, 1992

[54] SIDE GUARD FOR PATIENT SUPPORT

[75] Inventors: Charles M. Huck, Pottersville; Joseph Guglielmelli, Howell, both of N.J.

[73] Assignee: SSI Medical Services, Inc., Charleston, S.C.

[21] Appl. No.: 596,673

[22] Filed: Oct. 12, 1990

[51] Int. Cl.[5] ..... A47C 21/08

[52] U.S. Cl. ..... 5/430; 5/427

[58] Field of Search ..... 5/60, 425, 427, 430

[56] References Cited

U.S. PATENT DOCUMENTS

| | | | |
|---|---|---|---|
| 3,081,463 | 3/1963 | Williams et al. | 5/430 X |
| 3,932,903 | 1/1976 | Adams et al. | 5/63 X |
| 3,955,837 | 5/1976 | Christensen | 5/425 X |
| 4,564,965 | 1/1986 | Goodwin . | |
| 4,612,679 | 9/1986 | Mitchell | 5/425 |
| 4,638,519 | 1/1987 | Hess . | |
| 4,653,129 | 3/1987 | Kuck et al. | 5/430 |
| 4,672,699 | 6/1987 | Goodwin . | |
| 4,745,647 | 5/1988 | Goodwin . | |
| 4,768,249 | 9/1988 | Goodwin . | |
| 4,776,050 | 10/1988 | Goodwin . | |

FOREIGN PATENT DOCUMENTS

| | | | |
|---|---|---|---|
| 1212107 | 11/1970 | United Kingdom | 5/63 |
| WO8606624 | 11/1986 | World Int. Prop. O. . | |
| WO8809650 | 12/1988 | World Int. Prop. O. . | |
| WO8809651 | 12/1988 | World Int. Prop. O. . | |

*Primary Examiner*—Michael F. Trettel
*Attorney, Agent, or Firm*—Dority & Manning

[57] ABSTRACT

A side guard apparatus for a bed can be selectively depoloyed between a retracted position alongside the bed and an upright position above the support surface of the bed. A side guard member is pivotally connected to a base support member, which is pivotally connected to the side of the bed. A chain and sprocket linkage constrains rotation of the plane in which the side guard member is disposed during pivoting movement of the side guard member relative to the base support member and the pivoting movement of the base support member relative to the bed. The constant angle of orientation of the side guard member can be selectively changed. The side guard member and the base support member are locked into position and unlocked from this position by a pair of locking members resiliently urged by a pair of springs to insert their respective locking pins into openings defined in a pair of oppositely disposed mounting blocks. An alignment plate defines alignment slots which engage the locking members to ensure aligned translational movement of the locking members in a locking housing during the locking and unlocking movements of the locking members.

30 Claims, 8 Drawing Sheets

SIDE GUARD FOR PATIENT SUPPORT

BACKGROUND OF THE INVENTION

The present invention relates to restraints for the sides of beds and more particularly to side restraints which can be raised and lowered.

The provision of side rails along each longitudinal side of a bed to prevent the bed's occupant from rolling past each side edge of the bed has been known. Some of these side rails can be raised and lowered manually. Some side rails remain disposed essentially in the same vertical plane as they are raised and lowered. A side rail which folds upon itself in a single vertical plane in accordion-like fashion is shown in FIGS. 9 and 10 of U.S. Pat. No. 4,638,519 to Hess. However, this configuration could pose a danger to the occupant of the bed due to the multiple hinges connecting the side uprights to the cross rails. In addition, provision must be made at least at one end of the side rail to afford sufficient space for the collapsed upright to rotate 90° from the vertical direction and become positioned in the horizontal direction. This additional space to one end of the side rail effectively dictates the amount of space that can exist between two adjacent side rails. As shown in PCT Publication No. W086/06624 to Hunt, side rails also have been used in connection with articulatable low air loss patient supports. As shown in PCT Publication No. W088/09650 and PCT Publication No. W088/09651 to Vrzalik, non-articulating low air loss beds also are provided with side rails which can be raised and lowered in a vertical plane. Side rails which are raised and lowered by moving in a single vertical plane can operate like a guillotine and cause harm to body parts which may extend over the edge of the patient support when the side rail is being raised or lowered. As applied to a fluidized patient support system, which broadly speaking is a type of bed, shown in FIGS. 4 of U.S. Pat. Nos. 4,564,965, 4,672,699, and 4,776,050 to Goodwin, other side rails can be raised and lowered by being pivoted at one edge about a longitudinal axis of the side rail. Such pivoting side rails can only be raised and lowered where sufficient space exists to accommodate the full height of the side rail as it rotates between the raised and lowered positions.

OBJECTS AND SUMMARY OF THE INVENTION

It is a principal object of the present invention to provide an apparatus to be situated along a side of a bed, wherein the apparatus can be selectively positioned relative to the support surface of the bed to guard against the occupant rolling off the support surface of the bed.

Another principal object of the present invention is to provide a side guard for a bed, wherein the guard portion of the side guard can be raised and lowered in a confined space and without the apprehension for the safety of the bed's occupant that normally is associated with side rails which are raised and lowered in a single plane with guillotine-like or accordion-like movements.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the side guard apparatus of the present invention comprises a base support member which is configured and disposed to be pivotally carried by a patient support such as a bed disposed to be pivotally carried by a patient support such as a bed to which the side guard apparatus is to be mounted. The base support member defines a pair of bearing surfaces at each opposite end of the base support member. Each pair of bearing surfaces is configured to rotatably and support an elongated shaft.

In further accordance with the present invention, a side guard member is pivotally connected to the base support member. The side guard member is pivotally mounted at the end of the base support member that is opposite the end of the base support member configured to be pivotally carried by the patient support. The side guard member is positionable relative to the support surface of the bed so as to guard against the occupant rolling off the support surface of the bed. In addition, the side guard is moveable from the guardian position to a storage position wherein the side guard member is disposed below the support surface of the bed and against the side of the bed.

In yet further accordance with the present invention, means are provided for selectively maintaining the side guard member disposed in a plane oriented at a predetermined constant angle relative to a fixed reference plane during pivoting movement of the side guard member relative to the base support member. As embodied herein, the selective side guard member plane orientation means can include a first elongated shaft, a second elongated shaft, and means for linking rotation of the first and second shafts. The first shaft can be disposed to be rotatably carried by the bearing surfaces formed in one end of the base support member and held nonrotatably by a pair of mounting blocks fixed to the side of the bed. The second shaft can be disposed rotatably in the bearing surfaces at the opposite end of the base support member and held nonrotatably to the side guard member. In this way, the first shaft is configured and disposed to pivotally connect the base support member to the patient support via the mounting blocks. Similarly, the second shaft is configured and disposed to pivotally connect the side guard member to the base support member.

As embodied herein, the means for linking rotation of the first shaft and the second shaft can include at least a first sprocket wheel carried on the first shaft and at least a second sprocket wheel carried on the second shaft. The sprocket wheels are fixed nonrotatably relative to the shaft that carries them and are positioned on each shaft so that they are aligned with one another when the side guard apparatus of the present invention is completely assembled. The shaft rotation linking means can further include a chain which forms a continuous loop and comprises a plurality of links pivotally connected to one another. The chain is configured so as to be engaged by each sprocket wheel. The first and second sprocket wheels are identically configured and sized so as to result in a one-to-one correspondence between rotation of the first sprocket wheels and the second sprocket wheels via linkage of the chain. Each chain can include means for adjusting the length of the chain in the form of a double ended, elongated screw which has each threaded end received in a threaded turnbuckle. Each threaded turnbuckle is nonrotatably connected to one end of a pair of opposed ends of the chain. More than one double ended screw and associated turnbuckles can be provided for each chain.

According to the construction of the present invention, when the base support member pivots about the first shaft, which is nonrotatably held by the mounting blocks, the shaft rotation linking means prevents rotation of the second shaft. Since the side guard member is nonrotatably linked with the second shaft, the side guard member does not rotate relative to the second shaft or the first shaft during pivoting movement of the base support member about the first shaft. The chain moves relative to the indentically configured sprocket wheels in order to accommodate the pivoting movement without rotation of the shafts and sprocket wheels. Accordingly, the side guard member remains disposed in a plane oriented at a predetermined constant angle relative to a fixed reference plane during the pivoting movement of the side guard member relative to the base support member. Typically, the arbitrary fixed reference plane is selected to be the vertically disposed plane, as this is a desired orientation of a side guard member relative to the bed's support surface.

In yet further accordance with the present invention, means are provided for changing the constant angle between the plane of the side guard member and the fixed reference plane. This angle changing means can include the above-described means for adjusting the length of the chain. Upon lengthening the length of the chain by loosening the nut, the particular sprockets of the sprocket wheels engaged by the chain can be changed by pivoting the side guard member and the second shaft relative to the bearing surfaces of one end of the base support member to which the side guard member is pivotally mounted. When this different position has been attained, the chain length can be shortened by tightening the nut.

In still further accordance with the present invention, means are provided for selectively locking the side guard member against pivoting movement and alternatively unlocking the side guard member to permit the side guard member to remove pivotally with respect to the base support member. As embodied herein, the side guard member locking and unlocking means can include a pair of mounting blocks, a locking housing, and at least one locking member. Each mounting block defines at least a pair of elongated holes that line up with one another when the mounting blocks are fixed to the side of the bed. Desirably, the mounting block holes are oriented so that the line which aligns them with one another in a straight line will be oriented at a particular angle off of the vertical plane when the mounting blocks are mounted on the side of the bed. This permits the mounting blocks to offset the position of the base support member by this angle and enables the side guard apparatus of the present invention to be disposed beneath an overhanging portion of the bed so that upon retraction of the side guard member, it can be stored out of the way. The particular angle of this mounting block hole orientation depends upon the particular bed and location of the mounting blocks relative to any overhanging portion between the location of the mounting blocks on the side of the bed and the support surface of the bed.

The locking housing can be defined in the base support member near where the first shaft is rotatably carried by an end of the base support member. Moreover, the locking member is preferably provided with a second locking member so that one is provided for each mounting block Each locking member defines at least one locking pin and preferably a pair of locking pins that are configured and disposed to be received in the elongated holes of the mounting block. The ends of the locking pins can be specially configured to compensate for any misalignment between the mounting pins and these corresponding holes. Each locking member is translatable in the locking housing between a first extreme position and a second extreme position. In the first extreme position, each locking pin extends into a correspondingly aligned mounting block hole for a distance sufficient to prevent pivoting movement of the base support member relative to the mounting block. At the second extreme position, each locking pin is withdrawn sufficiently from the correspondingly aligned mounting block hole so as to allow pivoting movement of the base support member relative to the mounting block. It may be desirable or necessary to provide means to enable the locking pins of the locking member to access the elongated holes of the mounting blocks from the locking housing. In such instances, the accessing means can include access holes defined through side flanges which form the locking housing. Each access hole is aligned with each mounting pin of each locking member and with the correspondingly aligned elongated holes in each mounting block.

Means also can be provided for resiliently biasing each locking pin into a respective elongated hole of a respective mounting block. As embodied herein, resiliently biasing means can include a spring disclosed to produce a force that urges a locking member toward the first extreme position in which the locking member is positively locked into the elongated hole defined in the mounting block.

Means also can be provided for maintaining the proper alignment of the locking pins and the holes of the mounting blocks during translational movement of the locking members in the locking housing. As embodied herein, the alignment maintenance means can include an elongated flat flange extending from the end of each locking member opposite to the locking pins. A lip can be defined at a right angle to one edge of the flat flange. An alignment plate can define an elongated alignment slot for a locking member and a second alignment slot for the other locking member. Each alignment slot can be disposed and configured in a manner that ensures translation of each locking member proceeds along a path that places its locking pins in alignment with the respective elongated holes of its respective mounting block. The alignment plate can be disposed to cover the rear portion of the locking housing.

Means also can be provided for engaging each locking member to each respective alignment slot. As embodied herein, the engaging means can include a screw with a head wide enough to extend beyond the width of each alignment slot.

Further means can be provided for restraining the side guard member and the base support member against the side of the bed in the retracted position. As embodied herein, the retracted position restraining means can include a pair of flat plates, one plate disposed between each mounting block and the base support member. Each plate defines along a lower edge a cut out for receiving one of the locking pins to form a detent when the side guard member and base support member are disposed in the retracted position alongside the bed.

Thus, the components comprising the side guard constant angle maintenance means also provides means for selectively locking both the side guard member and the base support member against pivoting movement and alternatively unlocking both the side guard member and the base support member to permit the side guard member to moves pivotally with respect to the base support member and to permit the base support member to move pivotally with respect to the bed.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

Figure 1:
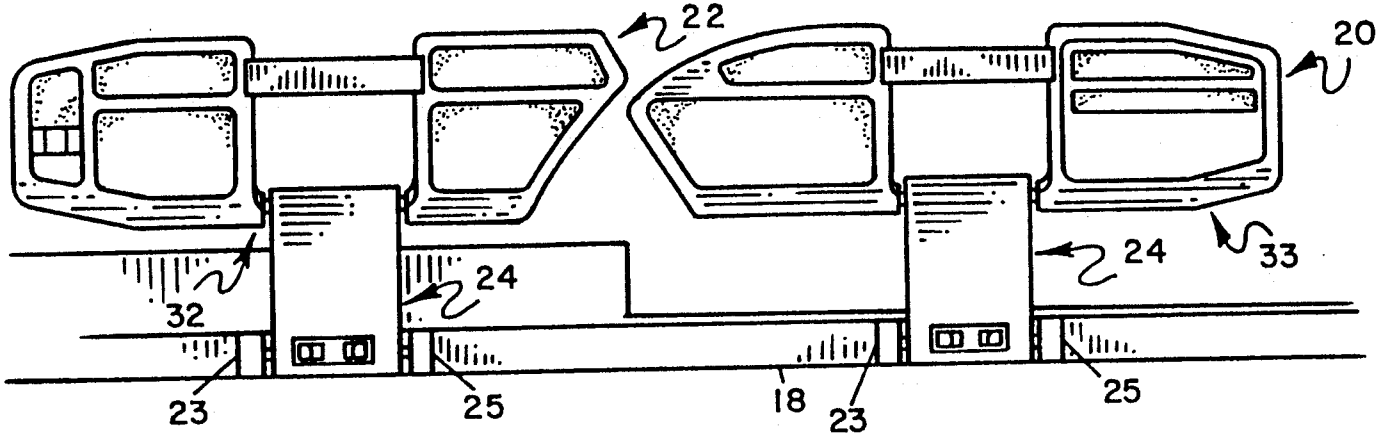
FIG. 1 illustrates a front plan view of embodiments of the present invention deployed in an upright position on a side of a patient support.
Figure 2:
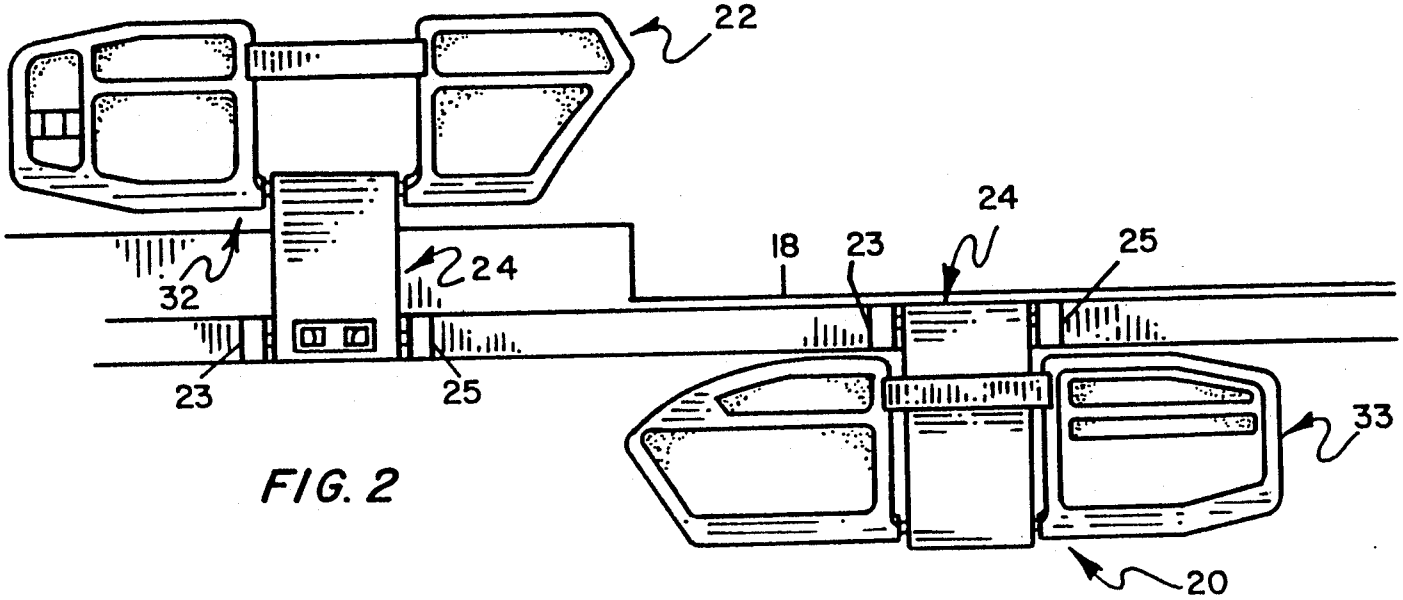
FIG. 2 illustrates a front plan view of embodiments of the present invention with one embodiment deployed in an upright position and another embodiment deployed in a retracted position on a side a patient support.

A preferred embodiment of a side guard in accordance with the present invention is shown in FIGS. 1 and 2 for example and is designated generally by the numeral 20. Alongside side guard 20 in FIGS. 1 and 2 is another preferred embodiment of a side guard in accordance with the present invention, and this second embodiment is designated generally by the numeral 22. Side guard 22 has a slightly different configuration than side guard 20, and the two side guards 20, 22 are designed to be used side-by-side on a patient support 18 which articulates generally at an intermediate location between the two side guards 20, 22.

In accordance with the side guard apparatus of the present invention, a base support member is provided. The base support member is configured and disposed to be pivotally carried by the patient support, such as a bed 18, to which the side guard apparatus is mounted. As embodied herein, a base support member is indicated generally by designating numeral 24 in FIGS. 1, 2, and 6 for example. As shown in FIGS. 3–9 for example, the base support member includes a pair of opposed side flanges 26, 27. As shown in FIG. 6 for example, each base support member side flange 26, 27 defines a bearing surface 28 at one end and a bearing surface 29 at the opposite end of each side flange 26, 27. Side flange bearing surfaces 28, 29 are configured to rotatably receive and support an elongated shaft. As shown in FIG. 6 for example, base support member 24 includes a connecting member 30 which extends between and maintains a constant separation distance between opposed side flanges 26, 27. The connecting member is shown in phantom in FIGS. 3–5 and broken away in FIGS. 7–9 for example. Opposed side edges of connecting member 30 are connected to side flanges 26, 27, the side edges not being visible in the Figures because the side edges are resting against a side surface of side flange 26 or 27.

In further accordance with the present invention, a side guard member is provided and is pivotally connected to the base support member. The side guard member is pivotally mounted at the end of the base support member that is opposite the end of the base support member configured to be pivotally carried by the patient support. As embodied herein and shown in FIGS. 1 and 2 for example, two different embodiments of a side guard member are designated generally by the numerals 32, 33. Side guard member 33 is shown in phantom in FIGS. 3–5 for example. As desired, the side guard members can be configured in any of a number of shapes, with or without open areas, and constructed of unitary structures or composite structures. As shown in FIGS. 1 and 2 for example, side guard member 32 includes a right hand portion which is sculpted at its lower right edge with a curvature that accommodates the upper left edge curvature of the left hand portion of side guard member 33, when the patient support 18 is articulated at a joint (not shown). Such joint would be located approximately midway between side guard 20 and side guard 22.

Figure 3:
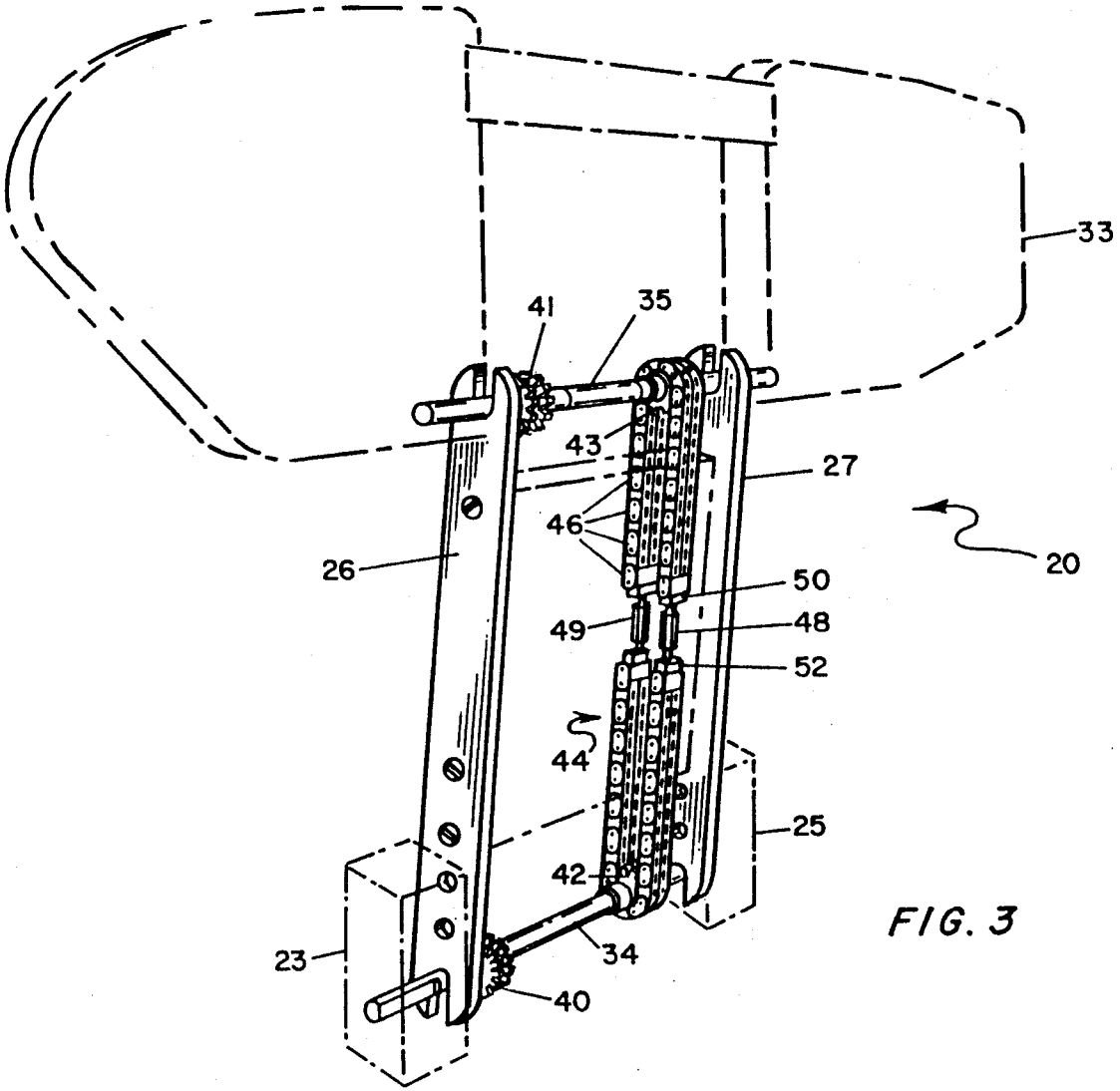
FIG. 3 illustrates an elevated perspective view of components of an embodiment of the present invention in an upright position with certain components shown only in phantom to avoid obscuring certain portions of the other components.
Figure 4:
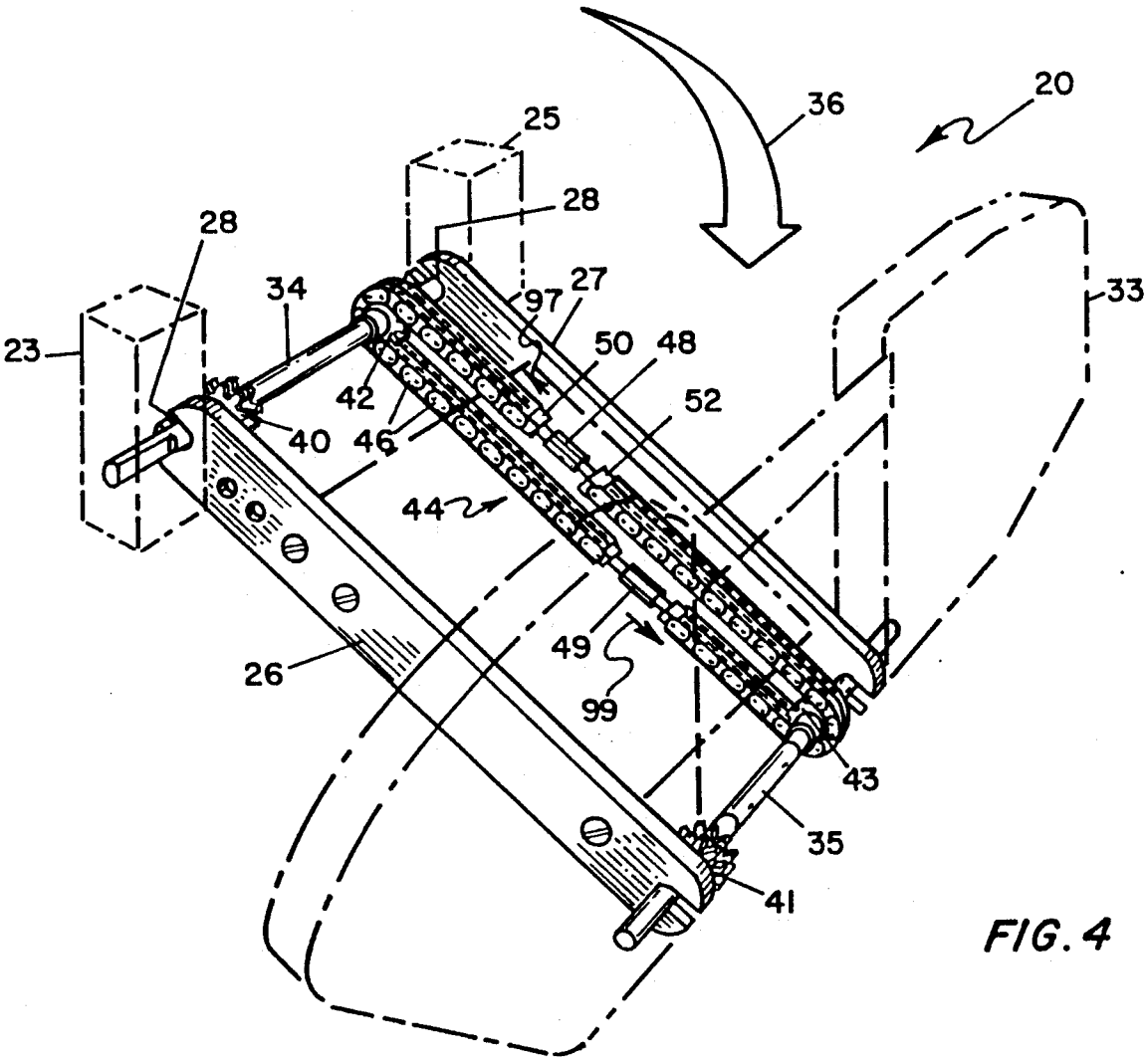
FIG. 4 illustrates an elevated perspective view of components of an embodiment of the present invention in an intermediate position between the upright and retracted positions with certain components shown only in phantom to avoid obscuring certain portions of the other components.
Figure 5:
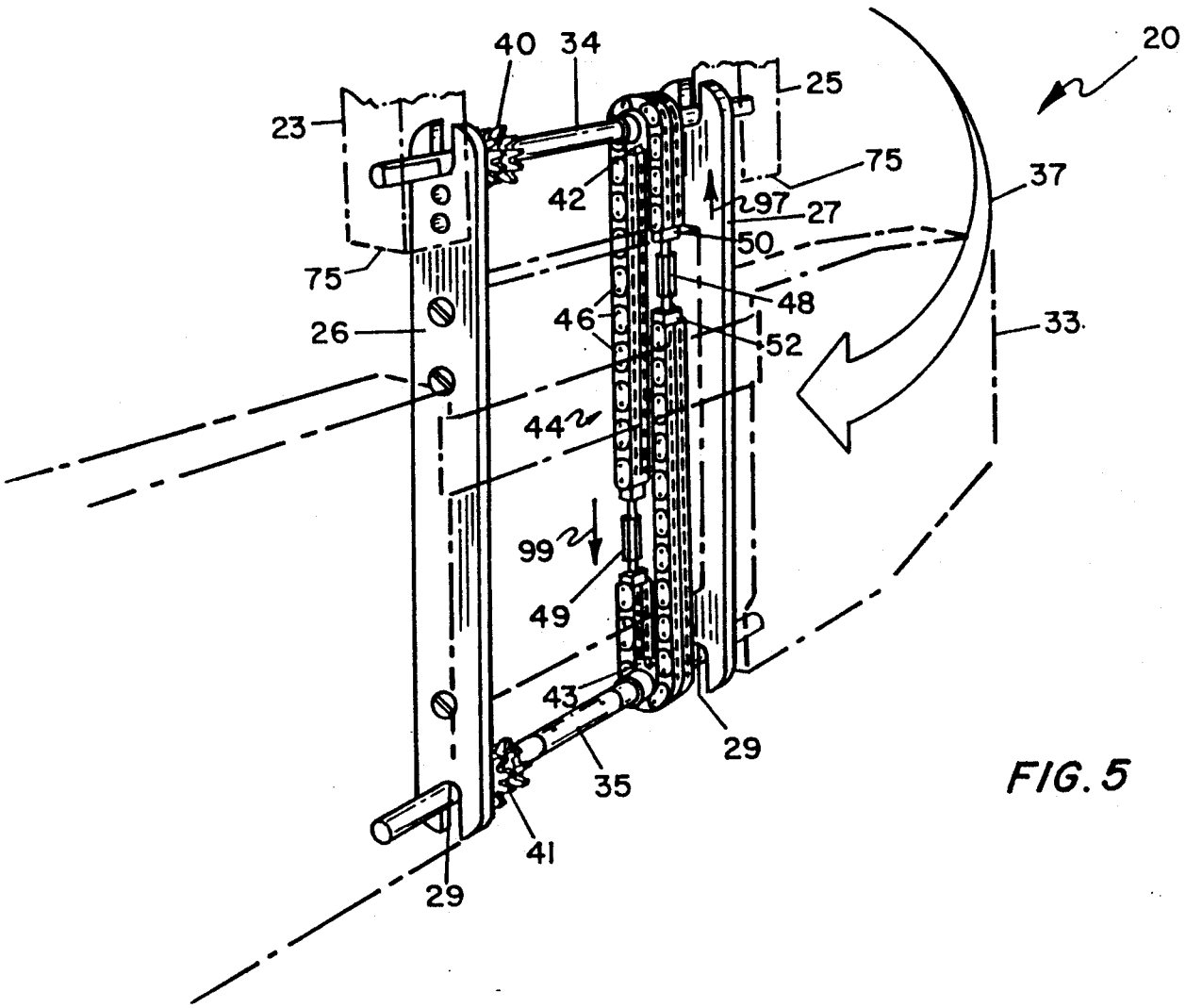
FIG. 5 illustrates an elevated perspective view of components of an embodiment of the present invention in a retracted position with certain components shown only in phantom to avoid obscuring certain portions of the other components.
Figure 6:
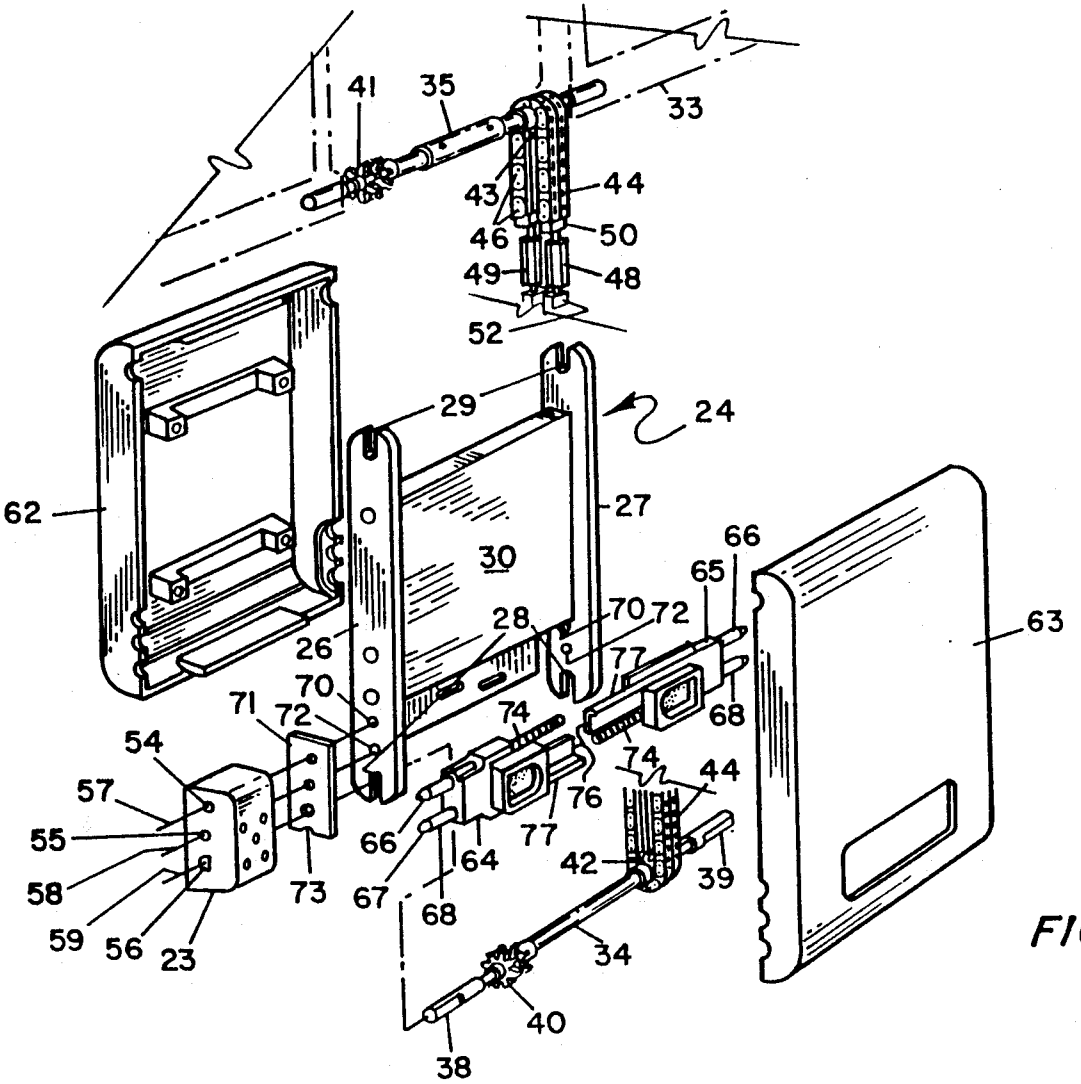
FIG. 6 illustrates an elevated perspective view of the assembly of certain components of the present invention with some components indicated in phantom or omitted altogether to avoid obscuring certain portions of the components shown in solid lines.

Referring to the sequence of movements illustrated in FIGS. 3, 4, and 5, FIG. 3 illustrates a side guard 20 in the upright position with side guard member 33 positioned relative to the support surface of the bed so as to guard against the occupant rolling off the support surface of the bed. FIG. 4 shows side guard member 33 and side flanges 26, 27 of side guard 20 moving in the direction of a large arrow 36 from the upright position shown in FIG. 3 toward a retracted position shown in FIG. 5. In the position shown in FIG. 5, further movement of side guard member 33 in the direction of arrow 37 retracts side guard 20 below the level of the support surface of the bed and against the side surface of the bed. Thus, during the movement between the fully upright position (shown in FIG. 3) and the fully retracted position (shown in FIG. 5), the base support member pivots with respect to the bed while the side guard member pivots with respect to the base support member.

In further accordance with the present invention, means are provided for selectively maintaining the side guard member disposed in a plane oriented at a predetermined constant angle relative to a fixed reference plane during pivoting movement of the side guard member relative to the base support member. The selective side guard member plane orientation means can include a first elongated shaft, a second elongated shaft, and means for linking rotation of the first shaft and the second shaft. As embodied herein and shown in FIGS. 3–6 for example, a first shaft 34 is disposed at one end of side flanges 26, 27, while a second elongated shaft 35 is disposed at the opposite end of side flanges 26, 27. First shaft 34 is configured and disposed to pivotally connect base support member 24 to patient support 18 via mounting blocks 23, 25 (described hereafter). Second shaft 35 is configured and disposed to pivotally connect side guard member 32, 33 to base support member 24. As shown in FIG. 4 for example, first shaft 34 is rotatably carried by bearing surfaces 28 at one of the ends of side flanges 26, 27. As shown in FIG. 5 for example, second shaft 35 is rotatably carried by bearing surfaces 29 at one of the ends of side flanges 26, 27. As shown in FIG. 6 for example, first shaft 34 has a first end defining a first surface 38 having a non-circular transverse profile so as to be configured to be nonrotatably held in a similarly configured elongated opening 56 defined in a corresponding mounting block 23 (described hereafter). Similarly, as shown in FIG. 6 for example, first shaft 34 has a second end defining a second surface 39 having a non-circular transverse profile so as to be configured to be nonrotatably held in a similarly configured elongated opening defined in a corresponding mounting block 25 (described hereafter). Thus, first shaft 34 is held against rotation relative to the mounting blocks 23, 25, which are mounted to the side of patient support 18. Bearing surfaces 28 at one of the extreme ends of side flanges 26, 27 rotatably receive first shaft 34, which is configured to be held nonrotatably by mounting blocks 23, 25. In this way, first shaft 34 is configured and disposed to pivotally connect base support member 24 to patient support 18.

As shown in FIGS. 3–6 for example, second shaft 35 has a first one of its ends received in a first opening defined in side guard member 33, while a second one of the ends of second shaft 35 is received in a second opening defined opposite the first opening in side guard member 33. Provision is made so that second shaft 35 is held nonrotatably relative to the side guard member. For example, the ends of the second shaft and the corresponding openings in the side guard member can have non-circular transverse cross-sectional profiles. Alternatively, a key way can be provided in the shaft end and the opening to receive a key that non rotatably fixes the shaft to the side guard member.

In accordance with the present invention, the means for linking the rotation of the first shaft and the second shaft can include at least a first sprocket wheel carried on the first shaft and at least a second sprocket wheel carried on the second shaft. Desirably, a pair of first sprocket wheels is carried by the first shaft, and one is disposed near each end of the first shaft. As embodied herein and shown in FIGS. 3–6 for example, first shaft 34 carries a pair of first sprocket wheels 40, 42. Desirably, a pair of second sprocket wheels is carried by the second shaft, and one is disposed near each end of the second shaft. As embodied herein and shown in FIGS. 3–6 for example, second shaft 35 carries a pair of second sprocket wheels 41, 43. As shown in the Figures, the first and second sprocket wheels are disposed on each respective first and second shaft so that when the side guard is assembled, each first sprocket wheel is in line with a corresponding second sprocket wheel. First sprocket wheels 40, 42 are fixed so as not to rotate relative to first elongated shaft 34. Similarly, second sprocket wheels 41, 43 are nonrotatably carried by second elongated shaft 35. A number 25, double sprocket, ¼ pitch, twelve teeth sprocket wheel is suitable for each of wheels 40, 41, 42 and 43.

As shown in FIGS. 3–6 for example, the shaft rotation linking means can further include a roller chain 44 which forms a continuous loop comprising a plurality of links 46 pivotally connected to one another. While not shown in the Figs., a second roller chain is provided for first sprocket wheel 40 and second sprocket wheel 41. The links of each chain 44 engage the spaces between the sprockets of each sprocket wheel, and each chain tightly engages both the first sprocket wheel on the first shaft and the corresponding second sprocket wheel on the second shaft. In this way, the two elongated shafts are constrained to rotate with one another. Similarly, first shaft 34 and second shaft 35 are both restrained against rotation whenever one of them is restrained against rotation. Thus, since first shaft 34 is held against rotation in mounting blocks 23, 25, second shaft 35 is prevented from rotating relative to first shaft 34 by virtue of being held against rotation by sprocket wheels 40, 41, 42, 43 and chains 44. Moreover, while the base support member pivots about shaft 34 on bearing surfaces 28 defined at one end of side flanges 26, 27, second shaft 35 does not rotate during such pivoting movement of base support member 24. Since side guard member 33 is nonrotatably linked with second shaft 35, side guard member 33 does not rotate relative to second shaft 35 during pivoting movement of base support member 24 about first shaft 34. Alternatively, the linking means could employ a system of cables and pulleys instead of chains 44 and the sprocket wheel system illustrated in the Figs.

In order to be able to maintain the side guard member disposed in a plane oriented at a predetermined constant angle relative to a fixed reference plane during pivoting movement of the side guard member relative to the base support member, the first sprocket wheels 40, 42 on the first shaft 34 must be the same size as the second sprocket wheels 41, 43 on the second shaft 35. Moreover, the configuration of the first sprocket wheels on the first shaft must be identical to the configuration of the second sprocket wheels on the second shaft. The correspondence in size and configuration between the sprocket wheels on each of the first shaft and the second shaft must be sufficient to result in a one-to-one correspondence between movement of the chains relative to the first sprocket wheels and relative to the second sprocket wheels. It is this one-to-one correspondence that ensures maintenance of the constant angle of side guard member 33 during its path between the raised and lowered positions. As the base support member pivots about first shaft 34, the individual links 46 of chains 44 move from one sprocket to the next sprocket on each sprocket wheel. This movement of the chain links can be followed in FIGS. 4 and 5 by noting the changes in the positions of screws 48 and 49 in the directions of arrows 97 and 99, respectively. The movement of the chains compensates for the angular movement of the base support member about the fixed first shaft 34 without rotation of second shaft 35. In this way, the side guard member, which is nonrotatably fixed to second shaft 35, remains disposed in a plane oriented at a predetermined constant angle relative to a fixed reference plane during the pivoting movement of the side guard member relative to the base support member. Any arbitrary fixed reference plane can be selected, including a vertically disposed fixed reference plane. Additionally, if one desired that side guard member 33 be disposed at a different angle in the upright position (FIG. 3) than when in the fully retracted position (FIG. 5), then instead of a one-to-one correspondence between the sprockets on first shaft 34 and second shaft 35, a different ratio between the sprockets would be provided. Depending upon the ratio between the first shaft sprocket and the second shaft sprocket, side guard member 33 could be disposed at a different angle, 5°0 for example, from the vertical plane when disposed in the upright position (FIG. 3) and at an angle of 0° from the vertical plane when disposed in the retracted position (FIG. 5), for example.

In addition, each chain 44 can include means for adjusting the length of the chain. As embodied herein and shown in FIGS. 3–6 for example, the means for adjusting the length of each chain can include an elongated double ended screw 48. Each threaded end of screw 48 is received in a threaded opening of a turnbuckle 50, 52. Each turnbuckle 50, 52 is nonrotatably connected to one end of a pair of opposed ends of chain 44. Moreover, as shown in FIGS. 3–6 for example, a second double ended screw 49 can be provided and configured to engage additional turnbuckles nonrotatably held in a second pair of opposed ends of chain 44. A hexagonally shaped cross-section ¼" diameter screw having 20 threads per inch on each end, one end being threaded in the opposite direction to the opposite threaded end of the screw, can serve as each double ended screw 48, 49. Accordingly, one turnbuckle 50 disposed to engage screw 48 should be threaded opposite to the other turnbuckle 52 disposed to engage the opposite end of screw 48.

In further accordance with the present invention, means are provided for changing the constant angle between the plane of the side guard member and the fixed reference plane. This angle changing means can include the above-described linking means and the means for adjusting the length of the chain which links the rotation of the first shaft to the second shaft. Whenever it is desired to change the angle that is formed between an arbitrary fixed reference plane and the plane of the side guard member, one merely disengages the linking means and adjusts the angular orientation of the side guard member relative to the base support member. For example, if it is desired to change the relative angle of orientation of side guard member 33 relative to base support member 24, one can manipulate screw 48 (FIG. 3) to extend the length of chain 44 sufficiently to loosen it. This loosening of the chain is effected by rotating screw 48 and/or screw 49 in the proper direction so that one or both screws retract from the threaded openings defined in their respective turnbuckles. When chain 44 is sufficiently loosened, the particular sprockets of sprocket wheels 40, 41, 42, 43 engaged by chain links 46 can be changed by pivoting side guard member 33 relative to base support member 24. In so moving side guard member 33 relative to the base support member, second shaft 35 is rotated relative to bearing surfaces 29 at one end of side flanges 26, 27 of base support member 24. Once the side guard member has been disposed at the desired relative angle of orientation, screw 48 and/or 49 is/are tightened to take up all of the slack of chain 44 and engage the sprockets of sprocket wheel 42 and sprocket wheel 43 so as to restrict any relative rotational movement between sprocket wheels 42, 43 and accordingly between the respective first shaft 34 and second shaft 35 which fixedly carry the sprocket wheels. Then the angle between the plane of side guard member 33 and the fixed reference plane becomes fixed at a new constant predetermined angle. Desirably, the plane of side guard member 33 resides at an angle of about 11° from the plane of base support member 24.

In further accordance with the present invention, means are provided for selectively locking the side guard member against pivoting movement and alternatively unlocking the side guard member to permit the side guard member to move pivotally with respect to the base support member. The side guard member locking and unlocking means can include a pair of mounting blocks, a locking housing, and at least one locking member. As embodied herein and shown for example in FIGS. 1, 2, and 7–9, a pair of mounting blocks 23, 25 is fixed to a side of patient support 18. As shown in FIG. 6 for example, each mounting block 23 defines three elongated holes 54, 55, and 56, shown in phantom in FIGS. 7–9. Mounting block 25 is a mirror image of mounting block 23 and similarly defines three elongated holes 54, 55, and 56. As shown in FIG. 6 for example, each mounting block hole 54, 55, and 56 is defined in the mounting block so that each hole's central longitudinal axis 57, 58, and 59 respectively, is parallel to one another. As shown in FIG. 6 for example, elongated holes 54, 55, and 56 of mounting block 23 are disposed in mounting block 23 so that a straight line is formed by the three points defined where a flat plane would intersect the central longitudinal axes 57, 58, and 59, respectively, of holes 54, 55, and 56. As shown in FIGS. 6–9 for example, elongated hole 56 is configured with a non-circular transverse cross-sectional profile. The other two elongated holes 54 and 55 are configured with a circular transverse cross-sectional profile, but need not be circular. Non-circular hole 56 is disposed adjacent only one of the other holes 54 and 55 in each block 23 or 25.

Figure 7:
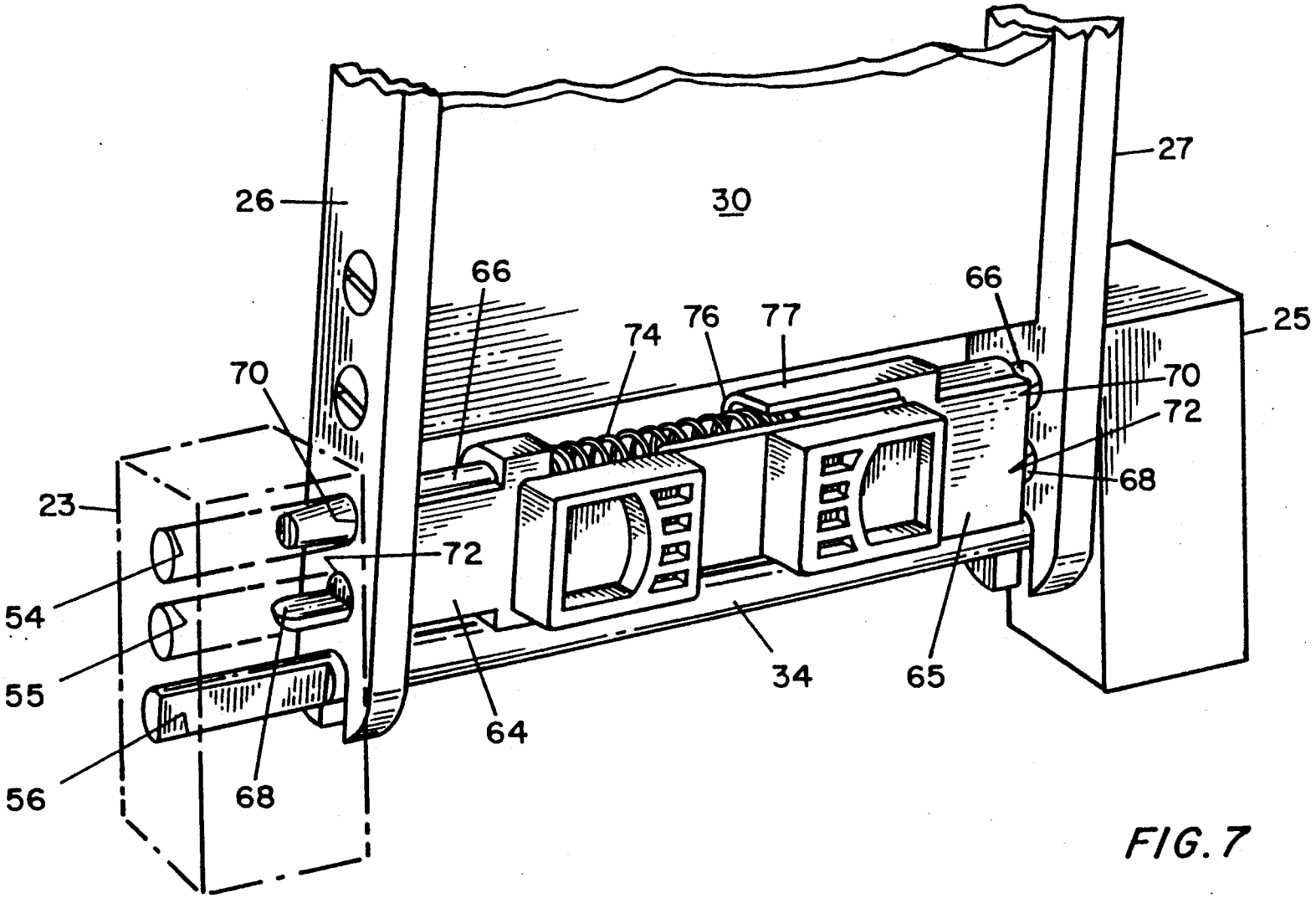
FIG. 7 illustrates an elevated perspective view of components of the present invention with certain components broken and others indicated in phantom.
Figure 8:
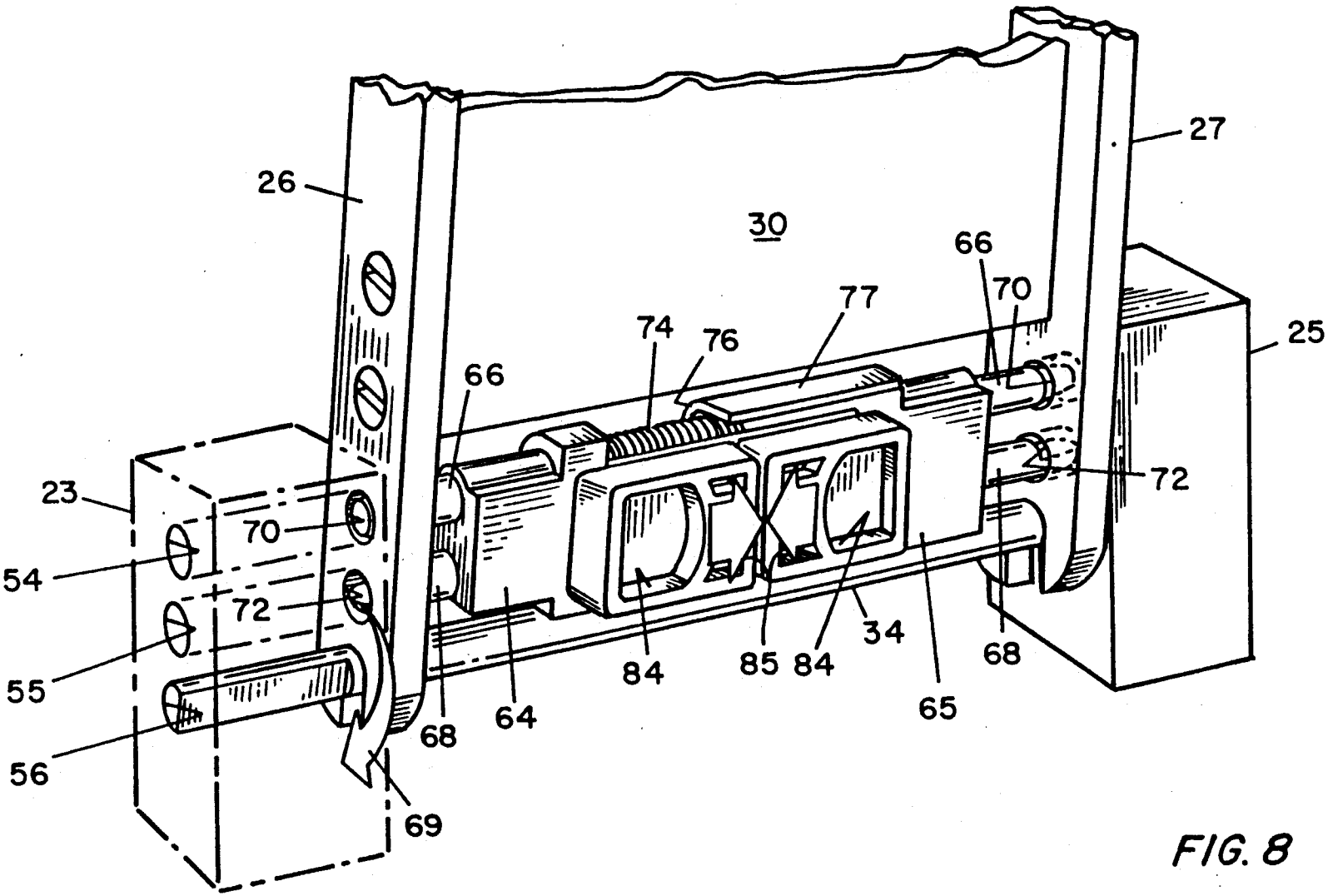
FIG. 8 illustrates an elevated perspective view of components of the present invention with certain components broken and others indicated in phantom.
Figure 9:
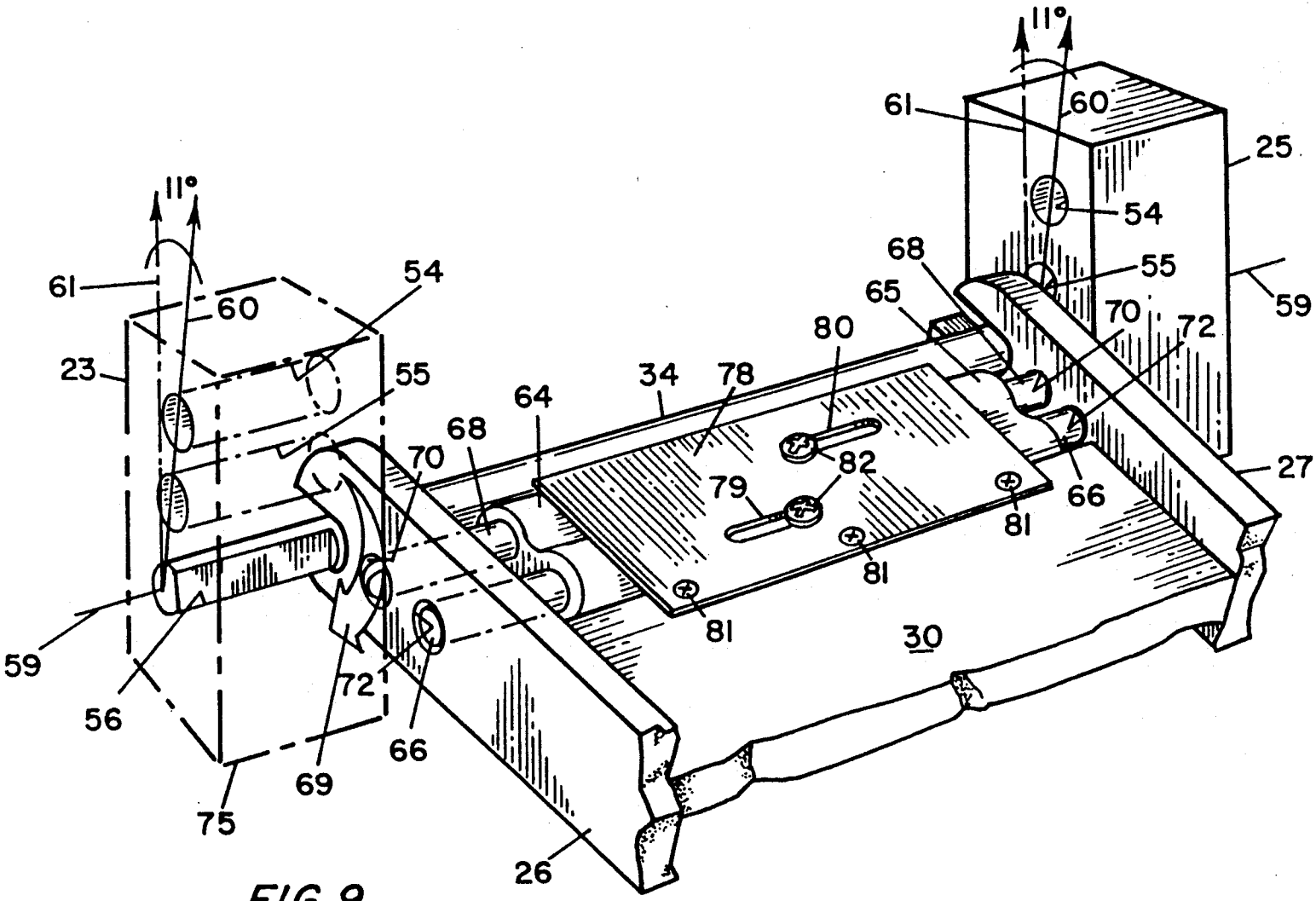
FIG. 9 illustrates an elevated perspective view of components of the present invention with certain components broken and others indicated in phantom.

As embodied herein and shown for example in FIGS. 1, 2, and 7–9, each mounting block 23, 25 has a surface which is configured to be fixed to a side of patient support 18. The surface configured to be fixed to the side of the bed is hidden from view in the Figs. However, as shown in FIGS. 1 and 2 for example, the surface of the side of bed 18 is flat, and the surface of the mounting blocks configured to be fixed to the side of the bed is similarly flat. Moreover, as shown in FIG. 9 for example, the mounting surface of each mounting block 23, 25 is configured so that a flat plane containing the central longitudinal axes of the three elongated holes 54, 55, and 56 is disposed at an angle of 11° from a vertically disposed plane. As shown in FIG. 9, an arrow 60 is drawn through the three points where the central longitudinal axes (only axis 59 is shown to avoid unduly complicating the drawing) of each of mounting block holes 54, 55, and 56 intersects where a flat plane would intersect the central longitudinal axes of these holes. A second arrow 61 is drawn to represent a vertically disposed plane that intersects the flat plane containing arrow 60. Note that an acute angle of 11° separates arrows 60 and 61. In the embodiment shown in FIGS. 1, 2, and 6–9, the mounting surface of each mounting block 23, 25 is a flat surface which resides in a vertically disposed plane which also contains the side surface of bed 18 to which the mounting blocks are fixed. As far as the requirements of the side guard member locking and unlocking means is concerned, at least a first elongated hole 54 or 55 for example of each mounting block is involved.

The side guard member locking and unlocking means also includes a locking housing. As embodied herein and shown in FIGS. 6–9 for example, a locking housing is defined by an end edge of connecting member 30, portions of side flanges 26, 27, and a rear cover 62 and a front cover 63 of base support member 24. Desirably, the locking housing is located near the ends of side flanges 26, 27 defining bearing surfaces 28 which rotatably support first shaft 34.

The side guard member locking and unlocking means also includes at least one locking member. As embodied herein and shown in FIGS. 6–9 for example, a pair of locking members 64, 65 is disposed within the locking housing. As shown in FIGS. 6–9 for example, each locking member 64, 65 defines at least one locking pin 66 or 68 and preferably a pair of locking pins 66, 68. As disposed in the embodiment shown in FIGS. 6–9 for example, pin 66 is the top pin and pin 68 is the bottom pin relative to one another. Each locking member 64, 65 is oriented in the locking housing so that its locking pins 66, 68 point toward a mounting block hole 54, 55 in an adjacent mounting block 23 or 25.

Locking pins 66, 68 are configured to be received within correspondingly aligned elongated holes 54, 55 of each respective mounting block 23, 25 so as to be easily inserted and withdrawn into holes 54, 55, yet securely received within these holes so that a snug fit is achieved. Though not shown in the Figs. to avoid unduly complicating the drawings, the closed ends of holes 54, 55 are configured similarly to the uniquely shaped ends of locking pins 66, 68 of each locking members 64, 65. As shown in FIGS. 6 and 7 for example, locking pin 66 has its free end configured as a truncated cone, and locking pin 68 has its free end configured as a hemisphere. In this way, if there is any misalignment between mounting pins 66, 68 and the corresponding holes 54, 55, the ends of the pins and the closed ends of the holes will touch one another and ensure a snug fit between the pin and the hole.

Each locking member 64, 65 is translatable in the locking housing between a first extreme position and a second extreme position. At the first extreme position shown in FIG. 7 for example, each locking pin 66, 68 extends into a correspondingly aligned mounting block hole 54, 55 for a distance sufficient to prevent pivoting movement of the base support member relative to the mounting block. At the second extreme position shown in FIGS. 8 and 9 for example, each locking pin 66, 68 of each locking member 64, 65 is withdrawn sufficiently from the correspondingly aligned mounting block hole 54, 55 to allow pivoting movement of the base support member relative to mounting block 23. The direction of pivoting movement is indicated in FIGS. 8 and 9 by an arrow designated 69.

Means also are provided to enable the locking pins of the locking member to access the elongated holes of one of the mounting blocks from the locking housing. As embodied herein and shown in FIG. 6–9 for example, the accessing means includes a respective access hole 70, 72 defined through each side flange member 26, 27 and disposed to be in alignment with a respective mounting block elongated hole 54, 55 and a mounting pin 66, 68 of each locking member 64, 65 when the respective locking member is disposed in the locking housing.

Means are provided for resiliently biasing the locking pins 66, 68 into a respective elongated hole 54, 55 of a respective mounting block 23, 25. As embodied herein and shown in FIGS. 6–8 for example, the resiliently biasing means preferably includes a spring 74 which is disposed to produce a force that urges locking member 64, 65 toward the first extreme position in which the locking members are positively locked into the elongated holes defined in the mounting blocks. The spring shown in the Figures is a coiled spring which is wrapped around a mounting post which is a short cylindrical portion of the locking member. The mounting post of the locking member extends in a direction opposite to the direction in which the locking pins 66, 68 extend and is shorter in length than spring 74 in its most compressed state.

Means also are provided for maintaining the proper alignment of the locking pins and the holes of the mounting blocks during translational movement of the locking members in the locking housing. As embodied herein and shown in FIGS. 6–8 for example, the alignment maintenance means preferably includes an elongated flat flange 76 extending from the end of each locking member 64, 65 opposite to locking pins 66, 68. Each flat flange further defines a lip 77 at a right angle to one edge of flat flange 76. As shown in FIG. 9 for example, the alignment means further includes an alignment plate 78 which defines one elongated alignment slot 80 for locking member 65 and a second alignment slot 79 for locking member 64. Alignment plate 78 is disposed to cover the rear portion of the locking housing and can be attached to connecting member 30 via screws 81 for example.

Means also are provided for engaging each locking member 64, 65 to each respective alignment slot 79, 80. As shown in FIG. 9 for example, the engaging means can include a screw 82 with a head wide enough to extend beyond the width of each alignment slot 79 or 80 and having its shaft extending into a threaded opening defined through each locking member 64, 65. A washer also can be used between the head of each screw 82 and alignment plate 78. As shown in FIG. 9 for example each alignment slot 79, 80 is disposed and configured in a manner that ensures that translation of each locking member 64, 65 proceeds along a path that places its locking pins 66, 68 in alignment with the respective elongated holes 54, 55 in mounting block 23 or 25. Typically, each alignment slot will be disposed parallel to locking pins 66, 68 when the locking member engages the respective alignment slot 79, 80.

Alternative embodiments of the side guard member locking and unlocking means can be provided. For example, a latching mechanism could be provided, and the operative movement of the latching mechanism can be in the horizontal direction (similar to the operative movement of the resiliently biased pin and hole device described above) or the vertical direction. Moreover, the alternative latching mechanism can be one based on a cam and slides or one based on cables and pulleys.

Further means can be provided for restraining the side guard member and the base support member against the side of the bed in the retracted position. As embodied herein and shown in FIG. 6 for example, the retracted position restraining means can include a flat bearing plate 71, which defines along a lower edge a cut out 73 for receiving one of the locking pins when side guard member 33 and the base support member are disposed in the retracted position alongside the bed. Bearing plate 71 is disposed between mounting block 23 and flange 26 of the base support member. Though not shown in the Figs. in order to avoid unduly complicating the drawing, a similar bearing plate with an appropriate cut out is desirably provided between mounting block 25 and flange 27. When side guard member 33 and the base support member are disposed in the retracted position (shown in FIG. 5 and lower right hand portion of FIG. 2) alongside the bed, locking pin 66 will be biased to extend beneath the bottom surfaces 75 of the associated mounting block 23, 25. This can be visualized by viewing FIGS. 5 and 9, in which bearing plates 71 are omitted in order to avoid unduly complicating the drawing. As shown in FIG. 6 for example, mounting pin 68 defines a smooth full rounded head 67. FIGS. 7–9 for example show mounting pin 68 with a half rounded head. However, the important feature is the ability of head 67 of mounting pin 68 to function as a detent in engaging cut out 73 when side guard member 33 and the base 5 support member are disposed in the retracted position. The tension provided by the biasing means such as springs 74, the shape and smoothness of head 67, and the size and shape of cut out 73 are factors which contribute to this ability. Thus, when side guard member 33 and the base support member are disposed in the retracted position, the friction provided by springs 74, which urge heads 67 of locking pins 68 against cut outs 73, restrains the base support member and side guard member 33 against the side of the bed. These same frictional forces must be overcome when beginning the movement of the side guard member from the retracted position in order to deploy the side guard member in the upright position (shown in FIGS. 1 and 3 for example).

Because of the construction of the embodiment illustrated in the Figs., the components comprising the side guard constant angle maintenance means also provides means for selectively locking both the side guard member and the base support member against pivoting movement and alternatively unlocking both the side guard member and the base support member to permit the side guard member to move pivotally with respect to the base support member and to permit the base support member to move pivotally with respect to the bed.

Operation of the illustrated embodiment of the present invention now will be described briefly. FIG. 3 illustrates side guard member 33 and a stripped down base support member disposed in the upright (i.e., raised) position. Though the bed is not shown, mounting blocks 23, 25 are mounted against the side of the bed, and side guard member 33 resides in a vertical plane relative to the horizontal plane defined by the support surface (not shown) of the bed. Note that the plane defined by side flanges 26, 27 of the base support member is disposed at an angle of 11° from the vertical plane which contains side guard member 33. This permits side guard member 33 to be disposed vertically, yet permits clearance of the base support member from any structures that extend beyond the portion of the bed to which mounting blocks 23, 25 are attached. The locking and unlocking means is not illustrated in FIG. 3, but is shown in FIG. 7 in the locked position. Locking pins 66, 68 extend into elongated holes 54, 55, respectively, for a sufficient distance to enable the base support member to be securely held in the position shown relative to mounting blocks 23, 25. Moreover, since sprocket wheels 40, 42, and 41, 43 are fixed against rotation relative to the respective first shaft 34 and second shaft 35 carrying them, chains 44 (only one chain 44 is shown in the Figs.) hold side guard member 33 in the vertical plane shown in FIGS. 3, 4, and 5. Turning to FIG. 8, a pair of finger slots 84 are defined in locking members 64, 65 and configured to permit the thumb and forefinger for example to squeeze locking members 64, 65 in a direction toward one another as indicated by arrows 85. This squeezing motion of the operator's fingers moves locking members 64, 65 against the biasing force of spring 74. Locking members 64, 65 thus are disposed in the second extreme position in which locking pins 66, 68 are completely withdrawn from their respective elongated holes 54, 55 defined in respective mounting blocks 23, 25.

Turning to FIG. 4, arrow 36 illustrates the direction of movement of side guard member 33 and the base support member which includes side flanges 26, 27. Arrows 97 and 99 show the directions of movement of screw 48 and screw 49, respectively, as side guard member 33 moves in the direction of arrow 36. This occurs as chains 44 are moving over the sprocket wheels to engage different sprockets of each wheel in order to accommodate the pivoting movement of the side guard member 33 and the base support member while shafts 34, 35 remain fixed against rotation. While it is true that the shafts do not themselves rotate during the pivoting movement, shaft 35 in the upright position of side guard member 33 shown in FIG. 3, moves from the twelve o'clock position relative to shaft 34 in FIG. 3 to the four o'clock position shown in FIG. 4, and then to about the six o'clock position shown in FIG. 5. It is this change in relative orientation between first shaft 34 and second shaft 35 that is accommodated by movement of the chains relative to the sprocket wheels, and accordingly relative to the shafts which nonrotatably carry the sprocket wheels. Moreover, the because the ratio of the sprockets on shaft 34 and sprockets on shaft 35 is one-to-one, the angular orientation of second shaft 35 relative to first shaft 34 does not change. In other words, the side guard constant angle maintenance means keeps side guard 33 oriented at the same angle relative to the plane in which side guard member 33 began the movement (shown in FIG. 3).

FIG. 9 illustrates in detail the lower portion of the mechanism near mounting blocks 23, 25 during the movement shown in FIG. 4. The position of the selective locking and unlocking means depicted in FIG. 9 is shown from the rear, while the position of the selective locking and unlocking means depicted in FIG. 8 is shown from the front, i.e., the view seen by the public when the bed is in use.

As shown in FIG. 5, arrow 37 points in the direction that the movement of side guard member 33 and the base support member must follow until they rest in the fully retracted position alongside of the bed (also referred to as the storage position). Again, arrows 97 and 98 illustrate the direction of movement of the chains and screws 48 and 49, respectively. In the fully retracted position shown in FIG. 5, both the base support member and side guard member 33 are disposed at the same angle relative to the plane in which side guard member 33 began the movement. In this case, side guard member 33 began the movement in a vertical plane, and thus side guard member 33 and the base support member are disposed in a vertical plane in the storage position shown in FIG. 5 for example.

Moreover, the degree to which there is more or less slack in chains 44 can play a role in determining the amount of frictional drag that occurs between first shaft 34 and bearing surfaces 28 and between second shaft 35 and bearing surfaces 29. The amount of drag determines how much force is required to move side guard member 33 between the upright position and the retracted position. Sufficient drag can be introduced so that the weight of side guard member 33 alone will be insufficient to cause it to move toward the retracted position after the locking means has been disengaged. In other words, a positive manual force beyond the force of gravity may be required to move the side guard member from the upright position to the retracted position. However, if desired, a separate damping mechanism may be provided to introduce a sufficient amount of drag on the movement of the side guard member. Such drag might be provided for example by coil springs mounted on the shafts to counterbalance the force of gravity during movement of the shafts relative to the bearing surfaces or by providing some other kind of damping mechanism.

The side guard mechanism of the present invention combines the pivoting movement of the base support member relative to the bed with the vertical movement of the side guard member relative to the bed. This enables the side guard to be raised and lowered without the danger of any guillotine movements of the side guard member relative to the patient occupying the support surface of the bed. The side guard mechanism of the present invention also permits deployment of the side guard member in the upright position and retraction of the side guard member in a storage position alongside the bed with a pivoting movement having a shorter radius of movement than conventional pivoting side guard mechanisms. Moreover, the orientation of the side guard member relative to the plane of the base support member and the plane of the support surface of the bed can be adjusted as desired. This provides flexibility as to mounting of the side guard member on the surface of the bed. For example, the mounting blocks can be disposed beneath an overhanging structure of the bed.

What is claimed is:

1. An apparatus to be situated along a side of a bed and which can be selectively positioned relative to the support surface of the bed to guard against the occupant rolling off the support surface of the bed, the apparatus comprising:

(a) a base support member, i) said base support member being configured to be pivotally carried by the bed;

(b) a side guard member, i) said side guard member being pivotally connected to said base support member;

(c) means for selectively maintaining said side guard member disposed in a plane oriented at a predetermined constant angle relative to a fixed reference plane during pivoting movement of said side guard member relative to said base support member; and (d) means for changing said constant angle between said plane of said side guard member and the fixed reference plane.

2. An apparatus as in claim 1, wherein:

said fixed reference plane is a vertically disposed plane.

3. An apparatus as in claim 1, wherein:

said constant angle is eleven degrees.

4. An apparatus as in claim 1, further comprising:

(d) means for selectively locking both said side guard member and said base support member against pivoting movement and alternatively unlocking both said side guard member and said base support member to permit said side guard member to move pivotally with respect to said base support member and to permit said base support member to move pivotally with respect to the bed.

5. An apparatus as in claim 1, further comprising:

(d) means for restraining the side guard member and the base support member in a retracted position against the side of the bed.

6. An apparatus as in claim 1, wherein:

said base support member defines a pair of opposed ends, one of said opposed ends being configured to be pivotally carried by the bed; and said side guard member is pivotally mounted at the end of said base support member opposite said end of said base support member which is configured to be pivotally carried by the bed.

7. An apparatus as in claim 1, further comprising:

(d) means for selectively locking said side guard member against pivoting movement and alternatively unlocking said side guard member to permit said side guard member to move pivotally with respect to said base support member.

8. An apparatus as in claim 30, wherein said means for selectively locking said side guard member against pivoting movement and alternatively unlocking said side guard member to permit said side guard member to move pivotally with respect to said base support member includes:

(a) a pair of mounting blocks configured to be fixed to one side of the bed;

(b) a locking housing, i) said locking housing being connected to said base support member;

(c) at least one locking member, i) said locking member being disposed in said locking housing;

ii) said locking member being translatable in said locking housing between a first extreme position wherein said locking member engages said mounting block sufficiently to prevent pivoting movement of said base support member relative to said mounting block and a second extreme position wherein said locking member disengages sufficiently from said mounting block to allow pivoting movement of said base support member relative to said mounting block.

9. An apparatus to be situated along a side of a bed and which can be selectively positioned relative to the support surface of the bed to guard against the occupant rolling off the support surface of the bed, the apparatus comprising:

(a) a base support member,
  i) said base support member being configured to be pivotally carried by the bed;
(b) a side guard member, p2 (i) said side guard member being pivotally connected to said base support member; and
(c) means for selectively maintaining said side guard member disposed in a plane oriented at a predetermined constant angle relative to a fixed reference plane during pivoting movement of said side guard member relative to said base support member, wherein said means for selectively maintaining said side guard member disposed in a plane oriented at a predetermined constant angle relative to a fixed reference plane during pivoting movement of said side guard member relative to said base support member includes:
  (a) a first elongated shaft,
    i) said first shaft being configured and disposed to pivotally connect said base support member and the bed;
  (b) a second elongated shaft,
    i) said second shaft being configured and disposed to pivotally connect said side guard member and said base support member; and
  (c) means for linking rotation of said first shaft and said second shaft.

10. An apparatus as in claim 9, wherein said means for linking rotation of said first shaft and said second shaft includes:

(a) at least a first sprocket wheel,
  i) said first sprocket wheel being carried by said first shaft; and
(b) at least a second sprocket wheel,
  i) said second sprocket wheel being carried by said second shaft.

11. An apparatus as in claim 10, wherein:
said first sprocket wheel and said second sprocket wheel are sized the same.

12. An apparatus as in claim 10, wherein:
said first sprocket wheel and said second sprocket wheel are configured the same.

13. An apparatus as in claim 10, further comprising:
(d) at least a first chain,
  i) said first chain engaging said sprocket wheels carried by said shafts.

14. An apparatus as in claim 13, wherein:
said first chain includes means for adjusting the length of said chain.

15. An apparatus as in claim 13, wherein:
i) said first chain being formed of a plurality of connected links, and
ii) each said link being pivotally connected to an adjacent link in said chain.

16. An apparatus as in claim 13, wherein:
said means for changing said constant angle between said plane of said side guard member and the fixed reference plane includes:
means for adjusting the length of said chain.

17. An apparatus as in claim 16, wherein:
said means for adjusting the length of said chain includes:
i) at least one double ended screw,
ii) each opposite end of said screw defining a threaded shaft,
iii) a pair of turnbuckles,
iv) each said turnbuckle defining a threaded opening configured to receive a threaded shaft of said screw, and
v) each said turnbuckle being nonrotatably connected to an end of said chain.

18. An apparatus as in claim 9, wherein:
i) said first shaft being configured to be nonrotatably connected to the bed,
ii) said first shaft being disposed to carry the end of said base support member which is configured to be pivotally carried by the bed,
iii) said second shaft being configured to be nonrotatably connected to said side guard member, and
iv) said second shaft being disposed to be pivotally carried by said base support member.

19. An apparatus to be situated along a side of a bed and which can be selectively positioned relative to the support surface of the bed to guard against the occupant rolling off the support surface of the bed, the apparatus comprising:

(a) a base support member,
  i) said base support member being configured to be pivotally carried by the bed;
(b) a side guard member,
  i) said side guard member being pivotally connected to said base support member; and
(c) means for selectively maintaining said side guard member disposed in a plane oriented at a predetermined constant angle relative to a fixed reference plane during pivoting movement of said side guard member relative to said base support member, wherein said means for selectively maintaining said side guard member disposed in a plane oriented at a predetermined constant angle relative to a fixed reference plane during pivoting movement of said side guard member relative to said base support member includes:
  i) a first elongated shaft, said first shaft being configured and disposed to pivotally connect said base support member and the bed,
  ii) a second elongated shaft, said second shaft being configured and disposed to pivotally connect said side guard member and said base support member, and
  iii) means for linking rotation of said first shaft and said second shaft, wherein said means for linking rotation of said first shaft and said second shaft includes:
    A) at least a first sprocket wheel, said first sprocket wheel being carried by said first shaft, and
    B) at least a second sprocket wheel, said second sprocket wheel being carried by said second shaft, wherein:
  i) said first sprocket wheel being nonrotatably carried by said first shaft; and
  ii) said second sprocket wheel being nonrotatably carried by said second shaft.

20. An apparatus to be situated along a side of a bed and which can be selectively positioned relative to the support surface of the bed to guard against the occupant rolling off the support surface of the bed, the apparatus comprising:

(a) a base support member,
i) said base support member being configured to be pivotally carried by the bed;

(b) a side guard member,
i) said side guard member being pivotally connected to said base support member;

(c) means for selectively maintaining said side guard member disposed in a plane oriented at a predetermined constant angle relative to a fixed reference plane during pivoting movement of said side guard member relative to said base support member;

(d) means for selectively locking said side guard member against pivoting movement and alternatively unlocking said side guard member to permit said side guard member to move pivotally with respect to said base support member, wherein said means for selectively locking said side guard member against pivoting movement and alternatively unlocking said side guard member to permit said side guard member to move pivotally with respect to said base support member includes:
i) a pair of mounting blocks configured to be fixed to one side of the bed,
ii) a locking housing,
A) said locking housing being connected to said base support member,
iii) at least one locking member,
A) said locking member being disposed in said locking housing,
B) said locking member being translatable in said locking housing between a first extreme position wherein said locking member engages said mounting block sufficiently to prevent pivoting movement of said base support member relative to said mounting block and a second extreme position wherein said locking member disengages sufficiently from said mounting block to allow pivoting movement of said base support member relative to said mounting block, wherein:
i) each said mounting block defining at least a first elongated hole,
ii) said locking member defining at least one elongated locking pin configured to extend into said at least one elongated hole of one of said mounting blocks,
iii) said locking member being oriented with said locking pin pointing toward said mounting block hole; and the apparatus further comprising:

(d) means for resiliently biasing said locking member into said at least one elongated hole of one of said mounting blocks.

21. An apparatus as in claim 20, wherein:
said means for resiliently biasing said locking member into said at least one of said elongated holes of said mounting block includes a biasing spring disposed to produce a force that urges said locking member toward said first extreme position.

22. An apparatus to be situated along a side of a bed and which can be selectively positioned relative to the support surface of the ed to guard against the occupant rolling off the support surface of the bed, the apparatus comprising:

(a) a base support member,
i) said base support member being configured to be pivotally carried by the bed;

(b) a side guard member,
i) said side guard member being pivotally connected to said base support member;

(c) means for selectively maintaining said side guard member disposed in a plane oriented at a predetermined constant angle relative to a fixed reference plane during pivoting movement of said side guard member relative to said base support member;

(d) means for selectively locking said side guard member against pivoting movement and alternatively unlocking said side guard member to permit said side guard member to move pivotally with respect to said base support member, wherein said means for selectively locking said side guard member against pivoting movement and alternatively unlocking said side guard member to permit said side guard member to move pivotally with respect to said base support member includes:
i) a pair of mounting blocks configured to be fixed to one side of the bed,
ii) a locking housing,
A) aid locking housing being connected to said base support member,
iii) at least one locking member,
A) said locking member being disposed in said locking housing,
B) said locking member being translatable in said locking housing between a first extreme position wherein said locking member engages said mounting block sufficiently to prevent pivoting movement of said base support member relative to said mounting block and a second extreme position wherein said locking member disengages sufficiently from said mounting block to allow pivoting movement of said base support member relative to said mounting block; and (e) an alignment plate,
i) said alignment plate being configured to cover part of said locking housing, and
ii) said alignment plate defining at least one elongated alignment slot therethrough; and wherein:
i) said locking member defining means for engaging said alignment slot, and
ii) said alignment plate being disposed to align said alignment slot parallel to the path of translation of said locking member in said locking housing.

23. An apparatus to be situated along a side of a bed and which can be selectively positioned relative to the support surface of the bed to guard against the occupant rolling off the support surface of the bed, the apparatus comprising:

(a) a base support member,
i) said base support member being configured to be pivotally carried by the bed;

(b) a side guard member,
i) said side guard member being pivotally connected to said base support member;

(c) means for selectively maintaining said side guard member disposed in a plane oriented at a predetermined constant angle relative to a fixed reference plane during pivoting movement of said side guard member relative to said base support member;

(d) means for selectively locking both said side guard member and said base support member against pivoting movement and alternatively unlocking both said side guard member and said base support member to permit said side guard member to move pivotally with respect to said base support member and to permit said base support member to move pivotally with respect to the bed, wherein said means for selectively locking both said side guard member and said base support member against pivoting movement and alternatively unlocking both said side guard member and said base support member to permit said side guard member to move pivotally with respect to said base support member and to permit said base support member to move pivotally with respect to the bed includes:

i) a pair of mounting blocks configured to be fixed to one side of the bed,
  A) each said mounting block defining at least a first elongated hole;
  ii) a locking housing,
  A) said locking housing being connected to said base support member;
  iii) at least one locking member,
  A) said locking member defining at least one elongated locking pin configured to extend into said at least one elongated hole of one of said mounting blocks,
  B) said locking member being disposed in said locking housing and oriented with said locking pin pointing toward said mounting block hole, and
  C) said locking member being translatable in said locking housing between a first extreme position wherein said locking pin extends into said mounting block hole sufficiently to prevent pivoting movement of said base support member relative to said mounting block and a second extreme position wherein said locking pin is withdrawn sufficiently from said mounting block hole to allow pivoting movement of said base support member relative to said mounting block.

24. An apparatus as in claim 23, further comprising:

(d) means for resiliently biasing said locking member into said at least one elongated hole of one of said mounting blocks.

25. An apparatus as in claim 24, wherein:

said means for resiliently biasing said locking member into said at least one of said elongated holes of said mounting block includes a biasing spring disposed to produce a force that urges said locking member toward said first extreme position.

26. An apparatus as in claim 23, further comprising:

(d) an alignment plate,
  i) said alignment plate being configured to cover part of said locking housing, and
  ii) said alignment plate defining at least one elongated alignment slot therethrough; and wherein:
i) said locking member defining means for engaging said alignment slot, and
ii) said alignment plate being disposed to align said alignment slot parallel to the path of translation of said locking member in said locking housing.

27. An apparatus to be situated along a side of a bed and which can be selectively positioned relative to the support surface of the bed to guard against the occupant rolling off the support surface of the bed, the apparatus comprising:

(a) a base support member,
  i) said base support member being configured to be pivotally carried by the bed;
(b) a side guard member,
  i) said side guard member being pivotally connected to said base support member;
(c) means for selectively maintaining said side guard member disposed in a plane oriented at a predetermined constant angle relative to a fixed reference plane during pivoting movement of said side guard member relative to said base support member; and
(d) means for restraining the side guard member and the base support member in a retracted position against the side of the bed, wherein said means for restraining the side guard member and the base support member in a retracted position against the side of the bed includes:
  i) a detent mechanism.

28. An apparatus to be situated along a side of a bed and which can be selectively positioned relative to the support surface of the bed to guard against the occupant moving across the edge of the support surface of the bed, the apparatus comprising:

(a) a base support member,
  i) said base support member being configured to be pivotally carried by the bed;
(b) a side guard member,
  i) said side guard member being pivotally mounted to said base support member;
(c) means for linking pivoting movement of said base support member to pivoting movement of said side guard;
(d) a pair of mounting blocks configured to be fixed to one side of the bed,
  i) each said mounting block defining at least a first elongated hole;
(e) a locking housing,
  i) said locking housing being connected to said base support member; and
(f) at least one locking member,
  i) said locking member defining at least one elongated locking pin configured to extend into said at least one elongated hole of one of said mounting blocks,
  ii) said locking member being translatable in said locking housing between a first extreme position wherein said locking pin extends into said mounting block hole sufficiently to prevent pivoting movement of said base support member relative to said mounting block and a second extreme position wherein said locking pin is withdrawn sufficiently from said mounting block hole to allow pivoting movement of said base support member relative to said mounting block.

29. An apparatus as in claim 28, wherein:

said means for linking pivoting movement of said base support member to pivoting movement of said side guard includes:
(a) a first elongated shaft,
  i) said first shaft being configured and disposed to pivotally connect said base support member and the bed;
(b) a second elongated shaft,
  i) said second shaft being configured and disposed to pivotally connect said side guard member and said base support member;
(c) at least a first sprocket wheel,
  i) said first sprocket wheel being nonrotatably carried by said first shaft;
(d) at least a second sprocket wheel,
  i) said second sprocket wheel being nonrotatably carried by said second shaft;

(e) at least a first chain,
i) said first chain engaging said sprocket wheels carried by said shafts.

30. An apparatus to be situated along a side of a bed and which can be selectively positioned relative to the support surface of the bed to guard against the occupant rolling off the support surface of the bed, the apparatus comprising:

(a) a pair of mounting blocks configured to be fixed to one side of the bed,
i) each said mounting block defining three elongated holes,
ii) said holes of each said block being defined in said block so that the central longitudinal axes of said holes are parallel,
iii) said holes of each said block being disposed in said block so that a straight line is formed by the three points defined where a flat plane intersects the central longitudinal axes of said holes,
iv) one of said holes in each block being configured with a noncircular transverse cross section,
v) each said noncircular transverse cross section hole being disposed adjacent only one of said other holes in said block,
vi) each said block defining a mounting surface for engaging one side of the bed,
vii) each said block mounting surface being configured so that a flat plane containing the central longitudinal axes of said three elongated holes is disposed at an angle of eleven degrees from a vertically disposed plane;

(b) a base support member,
i) said base support member being pivotally connected to said mounting blocks,
ii) said base support member including a pair of opposed side flanges,
iii) each said base support member side flange defining a bearing surface at each opposite end of each said side flange,
iv) said side flange bearing surfaces being configured to rotatably receive and support an elongated shaft,
v) said base support member including a connecting member extending between and maintaining a constant separation distance between said pair of opposed side flanges,
vi) said connecting member including a pair of opposed side edges,
vii) one of said side edges of said connecting member being connected to one of said side flanges and said opposite side edge of said connecting member being connected to the other of said side flanges;

(c) a first elongated shaft rotatably carried by said pair of bearing surfaces defined at one respective end of each said side flange,
i) one end of said elongated first shaft being configured to be held against rotation by one of said mounting blocks,
ii) the opposite end of said elongated first shaft being configured to be held against rotation by said other one of said mounting blocks,
iii) each end of said elongated first shaft being configured with a noncircular transverse cross sectional shape which is nonrotatably receivable by one of said noncircularly configured holes of said mounting blocks;

(d) a side guard member pivotally mounted at the end of said base support member opposite said end configured to be pivotally carried by the bed,
i) said side guard member defining a first opening and a second opening disposed opposite said first opening;

(e) a second elongated shaft,
i) said second elongated shaft being rotatably carried by said pair of bearing surfaces defined at the opposite respective ends of each said side flange,
ii) said second elongated shaft defining a first end and a second end disposed opposite said first end,
iii) said first end of said elongated second shaft being configured to be received within said first opening defined in said side guard member,
iv) said second end of said elongated second shaft being configured to be received within said second opening defined in said side guard member,
v) said elongated second shaft being held against rotation relative to said side guard member;

(f) means for maintaining said side guard member disposed in a plane oriented at a predetermined constant angle relative to a fixed reference plane during pivoting movement of said side guard member relative to said base support member,
i) said side guard plane orientation means including two pairs of sprocket wheels and one pair of chains,
ii) a first pair of said two pairs of sprocket wheels being nonrotatably carried by said first elongated shaft,
iii) a second pair of said two pairs of sprocket wheels being nonrotatably carried by said second elongated shaft,
iv) one sprocket wheel of said first pair of said two pairs of sprocket wheels being disposed near one end of said first elongated shaft,
iii) a second sprocket wheel of said first pair of said two pairs of sprocket wheels being disposed near the opposite end of said first elongated shaft,
v) one sprocket wheel of a second pair of said two pairs of sprocket wheels being nonrotatably carried near said first end of said second elongated shaft,
vi) a second sprocket wheel of said second pair of said two pairs of sprocket wheels being nonrotatably carried near said first end of said second elongated shaft,
vii) each of said pair of chains being formed of a plurality of connected links, each said link being pivotally connected to an adjacent link in said chain,
viii) a first one of said pair of chains extending between said first and second elongated shafts and engaging said sprocket wheels disposed toward one of the ends of said shafts,
ix) a second one of said pair of chains extending between said first and second elongated shafts and engaging said sprocket wheels disposed toward the opposite ends of said shafts;

(g) means for selectively locking said side guard member against pivoting movement and alternatively unlocking said side guard member to permit said side guard member to move pivotally with respect to said base support member,
i) said selective locking and alternative unlocking means including a locking housing, at least one locking member, means for accessing from said locking housing by said locking member said elongated holes of one of said mounting blocks, and means for resiliently biasing said locking member into at least one of said elongated holes of one of said mounting blocks, ii) said locking housing being disposed between said side flanges of said base support member, iii) said locking member defining at least one elongated locking pin configured to extend into one of said elongated holes of one of said mounting blocks, iv) said locking member being disposed in said locking housing and oriented with said locking pin pointing toward said mounting block hole, v) said accessing means including an access hole defined through one of said side flanges disposed between and aligned with both said elongated mounting block hole and said locking pin of said locking member disposed in said locking housing, vi) said locking member being translatable in said locking housing between a first extreme position wherein said locking pin extends through said access hole and into said mounting block hole sufficiently to prevent pivoting movement of said base support member relative to said mounting block and a second extreme position wherein said locking pin is withdrawn sufficiently from said mounting block hole to allow pivoting movement of said base support member relative to said mounting block, vii) said means for resiliently biasing said locking member into said at least one of said elongated holes of said mounting block includes a biasing spring disposed to produce a force that urges said locking member toward said first extreme position, viii) an alignment plate defining at least one elongated alignment slot therethrough, ix) said alignment plate being disposed to cover part of said locking housing and to align said alignment slot parallel to said locking pin, x) said locking member defining means for engaging said alignment slot; and (h) means for restraining the side guard member and the base support member in a retracted position against the side of the bed, i) said retracted position restraining means including a bearing plate and a rounded head formed on the free end of said locking pin, ii) said bearing plate being disposed between one of said mounting blocks and said base support member, iii) said bearing plate defining along a lower edge thereof a cut out, and iv) said cut out being configured and disposed for receiving said rounded head of said locking pin to form a detent when said side guard member and said base support member are disposed in the retracted position alongside the bed.

* * * * *